US009415586B1

(12) United States Patent
Hayashi

(10) Patent No.: US 9,415,586 B1
(45) Date of Patent: Aug. 16, 2016

(54) PRINTING CONTROL APPARATUS AND PRINTING CONTROL METHOD

(71) Applicant: Seiko Epson Corporation, Tokyo (JP)

(72) Inventor: Takuma Hayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/040,835

(22) Filed: Feb. 10, 2016

(30) Foreign Application Priority Data

Mar. 17, 2015 (JP) ..... 2015-053041

(51) Int. Cl.
*B41J 2/15* (2006.01)
*B41J 2/045* (2006.01)

(52) U.S. Cl.
CPC ..... *B41J 2/04551* (2013.01); *B41J 2/04586* (2013.01)

(58) Field of Classification Search
CPC ..... B41J 2/2132; B41J 2/155; B41J 2/2135; B41J 2/04543; B41J 11/008; B41J 2/2121; B41J 3/4078; B41J 2/01
See application file for complete search history.

(56) References Cited

U.S. PATENT DOCUMENTS 8,613,494 B2 * 12/2013 Uchida ..... B41J 2/145 347/41
8,757,756 B2 * 6/2014 Ashida ..... B41J 2/04505 347/14
8,888,219 B2 * 11/2014 Tanase ..... B41J 2/12 347/13
2011/0037799 A1 2/2011 Nakano et al.

FOREIGN PATENT DOCUMENTS

JP 2008-143092 A 6/2008
JP 2011-056942 A 3/2011
JP 2014-188925 A 10/2014

* cited by examiner

*Primary Examiner* — Lamson Nguyen

(57) ABSTRACT

A printing control apparatus which discharges ink from nozzles, while moving a printing head that includes at least a first nozzle row in which a plurality of nozzles capable of discharging a same type of ink are arranged in a predetermined nozzle row direction and a second nozzle row in which a plurality of nozzles capable of discharging the same type of ink are arranged in the nozzle row direction, in a main scanning direction intersecting with the nozzle row direction, in which, when, out of a group of raster lines corresponds to odd-numbered positions in the nozzle row direction and a group of raster lines which corresponds to even-numbered positions in the nozzle row direction, one group of the raster lines is printed by discharging the ink from the nozzle row out of the first nozzle row and the second nozzle row, which precedes during the movement.

8 Claims, 7 Drawing Sheets

DM1

DM2

PRINTING CONTROL APPARATUS AND PRINTING CONTROL METHOD

BACKGROUND

1. Technical Field

The present invention relates to a printing control apparatus and a printing control method.

2. Related Art

An ink jet printer is known which performs printing by discharging the ink onto a printing medium, using a printing head including a plurality of nozzle rows in which a plurality of nozzles capable of discharging a same type of ink are arranged in a nozzle row direction. In the ink jet printer, when one nozzle discharges the ink, a spiral air current (eddy air current) is generated in the vicinity of the nozzle according to discharging. Such eddy air current affects the ink discharged from the other nozzles in the vicinity. Specifically, the eddy air current causes an orbital of the ink discharged using the other nozzles in the vicinity to be disturbed, and causes deviation of a landed position of the ink on a printing medium. Such deviation of the landed position is visible as color unevenness in a printing result. The color unevenness generated by a result of the deviation of the landed position of the ink caused by the disturbance of the air current, such as the eddy air current, is referred to as wind ripple.

Moreover, an ink jet recording method is known in which the image data is allocated so that the number of discharging times the recording element rows positioned at a forward side of a travelling direction of recording main scanning becomes smaller than the number of discharging times the recording element rows positioned at a backward side in a plurality of recording element rows discharge the same color ink (refer to JP-A-2008-143092).

The eddy air current described above is suppressed by air current (contrary wind) from a forward side of the movement relatively generated due to a movement of the printing head. Accordingly, when a nozzle of the nozzle row positioned at a forward side of the movement direction among the plurality of nozzle rows discharges the ink, a growth of the eddy air current is suppressed, and thus, the wind ripple as described above is less likely to be generated. Meanwhile, when a nozzle of the nozzle row positioned at a backward side of the movement direction, air current from a forward side of the movement described above in which discharging of the ink using the nozzle row of the forward side becomes a type of wall (air wall) barely reaches, and thus the eddy air current is likely to be grow. That is, the ink discharged by the nozzle row positioned at the backward side of the movement direction, a deviation of the landed position is likely to be generated due to the influence of the eddy air current, as a result, the wind ripple is generated.

With respect to such a problem, as disclosed in JP-A-2008-143092, it is a concern that the growth of the eddy air current at the time of discharging the ink using the nozzle row positioned at the backward side of the movement direction is suppressed, by reducing the number of discharging times of the nozzle row positioned at the forward side of the movement direction. Meanwhile, by using the plurality of nozzle rows called the forward side and the backward side of the nozzle row at a same ratio, image quality is improved (for example, high printing resolution in the nozzle row direction can be realized). Accordingly, reducing the number of discharging times of the nozzle row positioned at the forward side of the movement direction in order to suppress the wind ripple, does not always achieve the best result.

SUMMARY

An advantage of some aspects of the invention is to provide a printing control apparatus and a printing control method capable of accurately exerting effects of an action for suppressing wind ripple.

According to an aspect of the invention, there is provided a printing control apparatus which discharges ink from nozzles, while moving a printing head that includes at least a first nozzle row in which a plurality of nozzles capable of discharging a same type of ink are arranged in a predetermined nozzle row direction and a second nozzle row in which a plurality of nozzles capable of discharging the same type of ink are arranged in the nozzle row direction, in a main scanning direction intersecting with the nozzle row direction, in which, when, out of a group of raster lines which are raster lines extending toward the main scanning direction and corresponds to odd-numbered positions in the nozzle row direction and a group of raster lines which corresponds to even-numbered positions in the nozzle row direction, one group of the raster lines is printed by discharging the ink from the nozzle row out of the first nozzle row and the second nozzle row, which precedes during the movement, and the other group of the raster lines is printed by discharging the ink from the nozzle row out of the first nozzle row and the second nozzle row, which follows during the movement, in a case in which a first printing mode is adopted, a ratio of the amount of the ink discharged from the following nozzle row with respect to the amount of the ink discharged from the preceding nozzle row, is set to be greater than the ratio thereof in a case in which a second printing mode different from the first printing mode is adopted.

In this case, a ratio of the amount of the ink discharged from the following nozzle row with respect to the amount of the ink discharged from the preceding nozzle row can be different due to the printing mode. For this reason, in the printing mode (first printing mode) where the wind ripple is likely to be generated relatively, a growth of the eddy air current at the time of discharging the ink discharged from the following nozzle row is suppressed by making the amount thereof smaller than the amount of the ink discharged from the preceding nozzle row, and thus, the wind ripple can be accurately suppressed.

In the printing control apparatus, a platen gap (hereinafter, PG), which is a distance from a platen supporting a printing medium on which the ink is discharged to the printing head, in the first printing mode, may be wider than a platen gap in the second printing mode.

In this case, the PG is wide, and thus, the wind ripple can be accurately suppressed in the printing mode (first printing mode) in which the wind ripple is likely to be generated relatively.

In the printing control apparatus, in the first printing mode, the printing medium on which the ink is discharged may be used as a first printing medium, and in the second printing mode, the printing medium on which the ink is discharged may be used as a second printing medium, and the first printing medium has a characteristic in which the ink is less likely to be blurred more than the second printing medium.

In this case, the first printing medium in which the ink is less likely to be blurred is used, and thus, the wind ripple can be accurately suppressed in the printing mode (first printing mode) in which the wind ripple is likely to be generated relatively.

In the printing control apparatus, the first printing mode may have the printing resolution in the main scanning direction higher than printing resolution of the second printing mode.

In this case, the printing resolution of the main scanning direction is high, and thus, the wind ripple can be relatively accurately suppressed in the printing mode (first printing mode) in which the wind ripple is likely to be generated.

In the printing control apparatus, when a dither matrix including a plurality of threshold values corresponding to each pixel is applied to image data in which a density of the ink in each of pixels constituting an image is expressed by gradation, printing data in which discharging or non-discharging of the ink in each pixel is determined is generated, and discharging of the ink from each nozzle is controlled according to the printing data, so that printing is realized, in the first printing mode, by comparing the dither matrix used in the second printing mode, the dither matrix may be used in which the plurality of threshold values corresponding to each pixel expressing the other group of the raster lines printed using the following nozzle row has many distributed low values more than the plurality of threshold values corresponding to each pixel expressing one group of the raster lines printed using the preceding nozzle row.

In this case, by using a different dither matrix according to the printing mode, easily and reliably, a ratio of the amount of the ink discharged from the following nozzle row with respect to the amount of the ink discharged from the preceding nozzle row can be different according to the printing mode.

In the printing control apparatus, when the printing may be realized by discharging the ink according to each movement of a main passage and a return passage in the main scanning direction by the printing head, the group of the raster lines corresponding to the even-numbered positions using the following nozzle row in the movement of the return passage is printed in a case in which the group of the raster lines corresponding to the odd-numbered positions using the following nozzle row in the movement of the main passage is printed, the group of the raster lines corresponding to the odd-numbered positions using the following nozzle row in the movement of the return passage is printed in a case in which the group of the raster lines corresponding to the even-numbered positions using the following nozzle row in the movement of the main passage is printed, and at least in the first printing mode, the dither matrix which is applied to a region where printing is performed by the main passage movement in the image, is different from the dither matrix which is applied to a region where printing is performed by the return passage movement in the image.

In this case, in the first printing mode, even when the printing is performed according to any one of the main passage movement and the return passage movement due to the printing head, the wind ripple can be suppressed by reducing the amount of the ink discharged from the preceding nozzle row.

In the printing control apparatus, the dither matrix used in the first printing mode may have all of the plurality of threshold values corresponding to each pixel expressing the other group of the raster lines printed using the following nozzle row, which are lower than all of the plurality of threshold values corresponding to each pixel expressing one group of the raster lines printed using the preceding nozzle row.

In this case, in the first printing mode, an image expressed by almost 50% or less of the density of the ink, is printed basically using only the following nozzle row, and thus, the wind ripple can be accurately suppressed in the printing mode.

Technical ideas of the invention are also realized an apparatus other than the printing control apparatus. For example, the invention may be realized by a method including processes executed by the printing control apparatus (printing control method), a computer program causing the method to executed by a computer, or various categories of recording mediums which can be read by the computer storing the program.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to each of drawings. Each of the drawings only is exemplified for describing the embodiments, and may not match with the others.

1. Schematic Description of Apparatus

Figure 1:
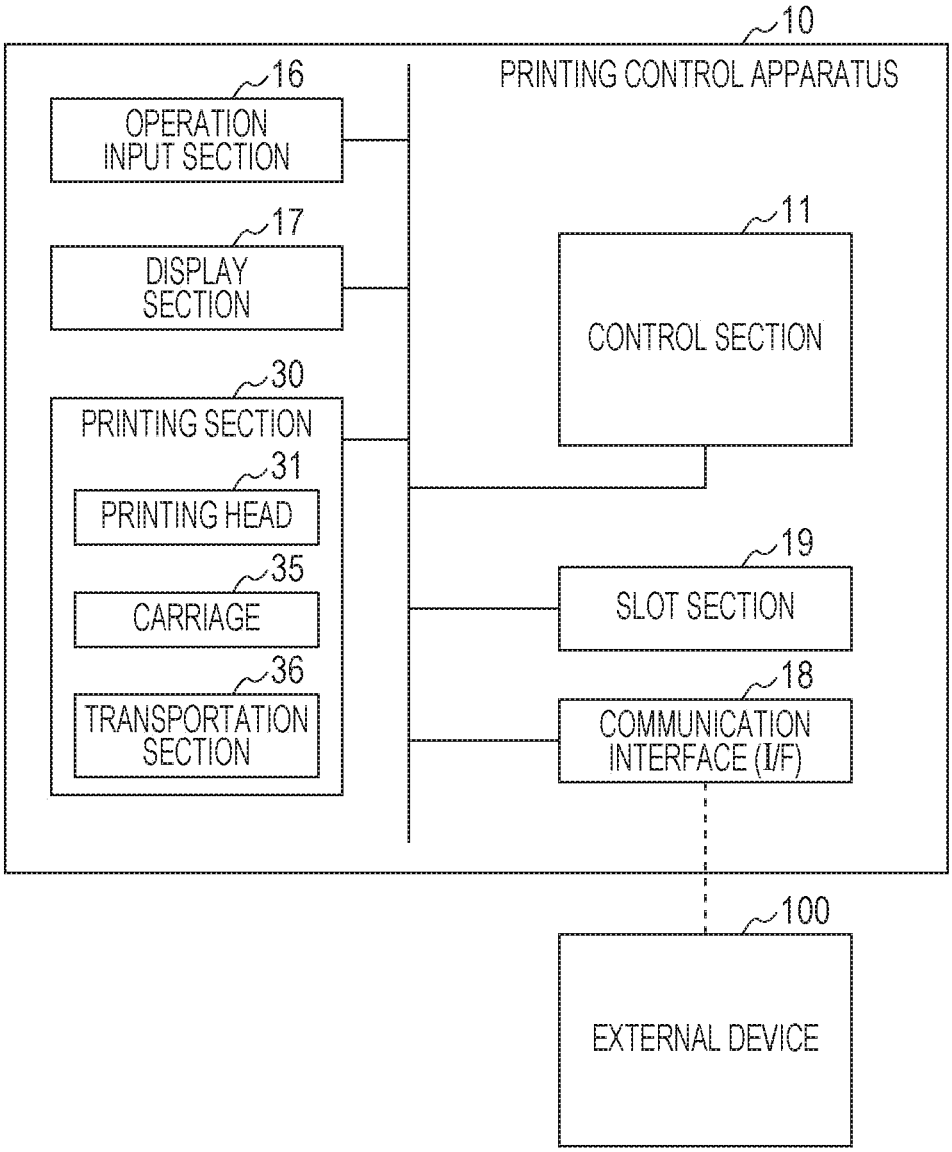
FIG. 1 is a block diagram exemplifying a configuration of an apparatus according to an embodiment.

FIG. 1 exemplifies functions of a printing control apparatus 10 according to the embodiment as a block diagram. The printing control apparatus 10 is recognized as a product, for example, a printer, or a multifunction machine including a function of the printer. When the printing control apparatus 10 is configured to have a printing section 30 which actually performs printing on a printing medium, and a configuration of a part for controlling a behavior of the printing section 30 (for example, control section 11 described later), the configuration of a part may be referred to as the printing control apparatus 10. In addition, the printing control apparatus 10 may be referred to as a printing apparatus, an image processing apparatus, or the like. Each of configurations illustrated in FIG. 1 is not limited to a case in which components are aggregated in one position or one case, and may be a system in which the components are present at a position by being separated from each other respectively and in a state of being capable of communication. For example, the printing control apparatus 10 may be configured to have a printer which actually performs printing on the printing medium and an apparatus (personal computer, or the like) in which a computer program (printer driver) for controlling a behavior of the printer is mounted so as to control the printer.

FIG. 1 exemplifies the printing control apparatus 10 which is configured to have the control section 11, an operation input section 16, a display section 17, a communication interface (I/F) 18, a slot section 19, a printing section 30, and the like. The control section 11 is configured to have, for example, an IC including a CPU, a ROM, a RAM, and the like, or the other recording medium, and the like. In the control section 11, the CPU realizes various processing (for example, printing control process to be described later) by executing arithmetic processing according to a program which is stored in the ROM, or the like by using the RAM, or the like as a work area.

The operation input section 16 includes various buttons, keys, or the like for receiving an operation performed by a user. The display section 17 is a portion for displaying various information relating to the printing control apparatus 10, and is formed of, for example, a liquid crystal display (LCD). A part of the operation input section 16 may be realized as a touch panel displayed on the display section 17.

The printing section 30 is a mechanism for printing an image on the printing medium. When a printing method is an ink jet method which is applied to the printing section 30, the printing section 30 is configured to have a printing head 31 (refer to FIG. 3), a carriage 35 which moves (main scanning) the printing head 31 in a predetermined main scanning direction, a transportation section 36 which transports the printing medium in a transportation direction intersecting with the main scanning direction, and the like.

The printing head 31 receives various ink supplied from each ink cartridge (not illustrated) of a plurality types of ink (for example, cyan (C) ink, magenta (M) ink, yellow (Y) ink, black (K) ink, and the like). The printing head 31 is capable of discharging (ejecting) ink (ink droplets) from a plurality of nozzles 34 (refer to FIG. 3) which are provided to correspond to various ink. Printing is realized when the discharged ink is landed onto the printing medium so as to form dots on the printing medium. The term "dots" basically means ink droplets which are landed onto the printing medium; however, even in a description relating to a process before the ink droplets are landed on the printing medium, an expression of "dots" can be appropriately used. Specific types or numbers of liquid used for the printing section 30 are not illustrated, and for example, various inks or liquid such as light cyan, light magenta, orange, green, gray, light gray, white, metallic, and the like can be used.

The transportation section 36 includes rollers for supporting and transporting the printing medium or motors for rotating the rollers (neither is illustrated). The printing medium is typical paper. However, in the embodiment, when the printing medium is made of a material which is capable of performing recording with liquid and being transported by the transportation section 36, a material other than paper is also included in a concept of the printing medium.

The communication I/F 18 is a general term of an interface for connecting the printing control apparatus 10 to an external device 100 by wired or wireless communication. As the external device 100, for example, there are various devices such as smart phones, tablet type terminals, digital steel cameras, and personal computers (PC), which become an input source of image data to the printing control apparatus 10. The printing control apparatus 10 can be connected to the external device 100 through the communication I/F 18, and for example, through various units such as a USB cable, a wired network, a wireless LAN, or an electronic mail communication or communication standard.

The slot section 19 is a portion for introducing an external recording medium such as a memory card. That is, the printing control apparatus 10 is also capable of inputting image data stored in a recording medium, from the external recording medium such as a memory card which is inserted into the slot section 19.

Figure 2:
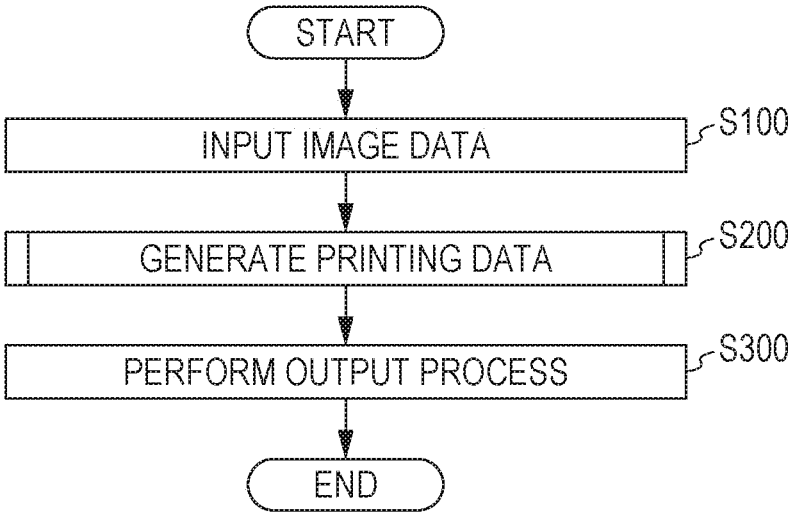
FIG. 2 is a flow chart illustrating a printing control process.

FIG. 2 illustrates a printing control process which is performed by the control section 11 using a flow chart. When inputting the image data (Step S100), the control section 11 performs an image process for generating printing data from the image data (Step S200). A format of the image data is considered as various types, and for example, is data in which gradation is expressed using RGB (red, green, and blue) in each pixel. The control section 11 appropriately performs an image process such as a resolution conversion process, a color (color model) conversion process, and a halftone process with respect to the image data, so as to generate printing data in which an image of a printing object is expressed as a pattern of dots using a plurality of pixels.

The pattern of dots (dot pattern) is an arrangement of ON of the dots (formation of dots, that is, ink discharging) • OFF of the dots (non-formation of dots, that is, ink non-discharging), and it can be said that the pattern specifies ON or OFF of the dots in each pixel. For example, in a case in which the printing head 31 discharges CMYK ink, printing data includes data, which specifies ON or OFF of dots in each pixel, in each CMYK. Moreover, Step S200 will be described later in detail.

Regarding each pixel constituting such printing data, the control section 11 determines a nozzle 34 of an allocated address, and performs an output process in which, according to a determined result, the resultant is transmitted to the printing head 31 by rearranging a predetermined arrangement for being transmitted to the printing head 31 (Step S300). By allocating each of pixels to the nozzle 34, it is confirmed that the dot of each of pixels constituting the printing data is discharged according to colors of the ink and the pixel position, by any nozzle 34 of the printing head 31, and in any number of main scanning, at any timing during the main scanning.

The printing head 31 drives each nozzle 34 based on the transmitted printing data. For example, a driving signal (type of pulse) for driving each nozzle 34 is applied to the printing head 31 by the control section 11. A detailed description will not be repeated; however, in the printing head 31, applying the driving signal provided in each nozzle 34 to a driving element is switched, according to information relating to ON or OFF of the dots in each pixel specified by the printing data. Accordingly, each nozzle 34 realizes discharging and non-discharging of the ink according to information relating to the pixel allocated thereto.

Figure 3:
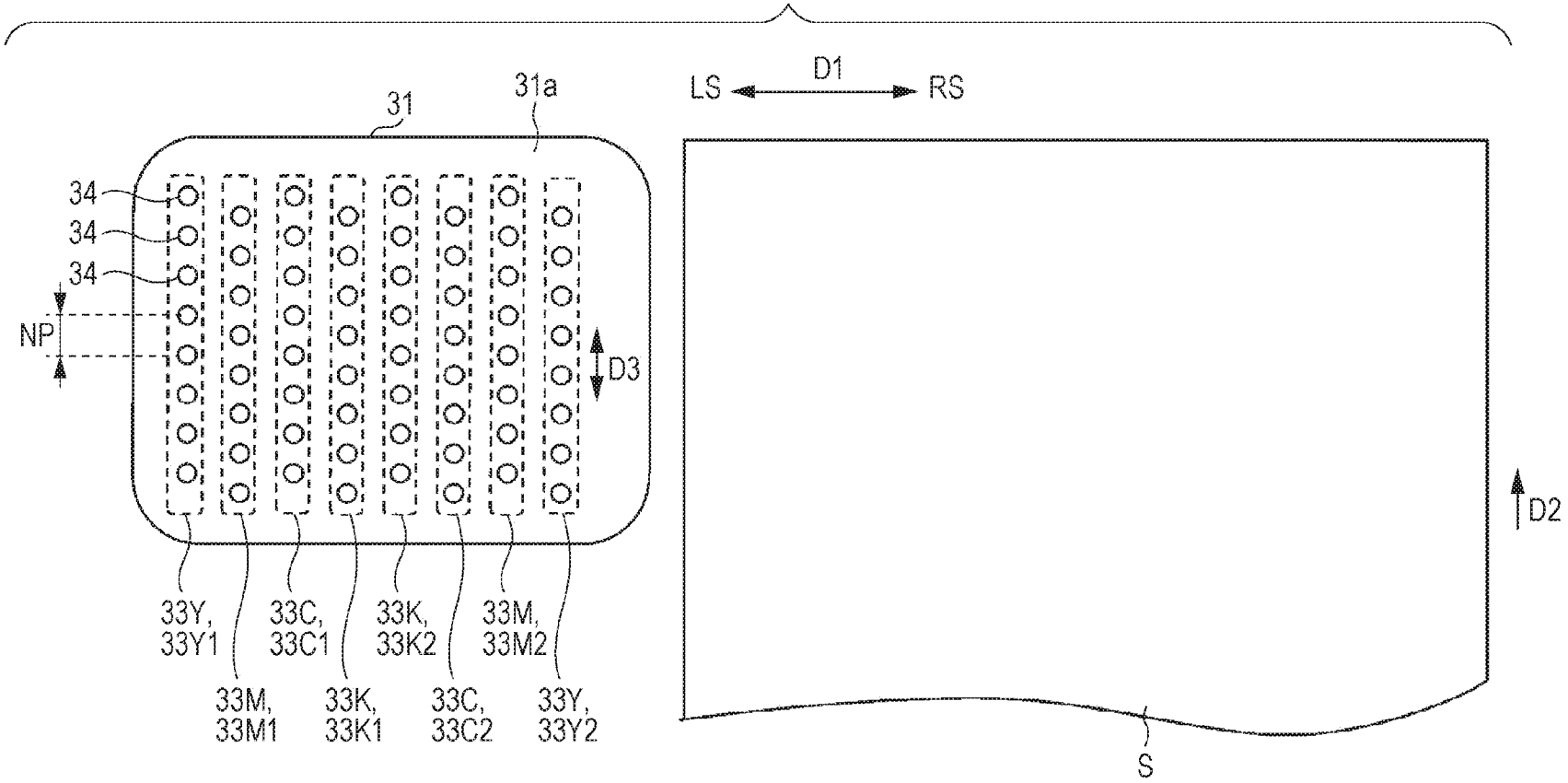
FIG. 3 is a diagram exemplifying a configuration of a printing head.

FIG. 3 simply exemplifies a configuration, or the like of the printing head 31. In FIG. 3, an arrangement of the nozzles 34 in an ink discharging surface 31*a* of the printing head 31 is exemplified from a point of view when seen from the top of the printing head 31. In FIG. 3 (and FIG. 5 to be described later), each of the nozzles 34 is expressed by a circle. The ink discharging surface 31*a* is a surface in which the nozzles 34 are open, and is a surface facing the printing medium S transported by the transportation section 36 in a transportation direction. In FIG. 3, a direction D1 corresponds to a main scanning direction, and a direction D2 corresponds to a transportation direction. Basically, the main scanning direction D1 and the transportation direction D2 are orthogonal to each other.

In an example of FIG. 3, the printing head 31 includes nozzle rows 33C, 33M, 33Y, and 33K of each color of ink. Either of the nozzle rows 33C, 33M, 33Y, and 33K is present as two rows or more. The nozzle row 33C is a nozzle row in which the plurality of nozzles 34 for discharging the C ink are arranged in a predetermined nozzle row direction D3 with predetermined intervals (constant nozzle pitch NP). In the same manner, the nozzle row 33M is a nozzle row in which the plurality of nozzles 34 for discharging the M ink are arranged in the nozzle row direction D3 with the nozzle pitch NP, the nozzle row 33Y is a nozzle row in which the plurality of nozzles 34 for discharging the Y ink are arranged in the nozzle row direction D3 with the nozzle pitch NP, and the nozzle row 33K is a nozzle row in which the plurality of nozzles 34 for discharging the K ink are arranged in the nozzle row direction D3 with the nozzle pitch NP.

The nozzle row direction D3 where the nozzle row extends toward intersects with the main scanning direction D1. It depends on a design of the printing section 30; however, the nozzle row direction D3 is orthogonal to the main scanning direction D1, or intersects with the main scanning direction at an oblique angle which is not orthogonal thereto (90 degrees). In the example of FIG. 3, the nozzle row direction D3 is orthogonal to the main scanning direction D1. Accordingly, in the example of FIG. 3, the nozzle row direction D3 and the transportation direction D2 are parallel to each other. Also, in this specification, even when expressions which are strictly interpreted, such as "orthogonal", "parallel", and "constant", are used, it does not mean "orthogonal", "parallel", and "constant", and error allowable within product performance or error generated at the time of manufacturing the product is also included in the meaning.

In a case in which the main scanning direction D1 is referred to as a horizontal direction for convenience of description, the nozzle rows 33C, 33M, 33Y, and 33K are arranged in a state of being symmetrical. In FIG. 3, from a left side LS to a right side RS of the main scanning direction D1, eight nozzle rows are arranged in order of the nozzle row 33Y, the nozzle row 33M, the nozzle row 33C, the nozzle row 33K, the nozzle row 33K, the nozzle row 33C, the nozzle row 33M, and the nozzle row 33Y. When focusing on a combination of the nozzle rows which discharge the same kind of inks (hereinafter, referred to as same color nozzle rows group), one nozzle row of the same color nozzle rows group is referred to as a first nozzle row, and the other nozzle row thereof is referred to as a second nozzle row. Hereinafter, for convenience of description, as illustrated in FIG. 3, in the 8 rows of the nozzle rows, four rows of the left side LS respectively correspond to the first nozzle row, and four rows of the right side RS correspond to the second nozzle row.

In the same color nozzle rows group of the C ink, a row corresponding to the first nozzle row is notated as a nozzle row 33C1, and a row corresponding to the second nozzle row is notated as a nozzle row 33C2. In the same manner, in the same color nozzle rows group of the M ink, a row corresponding to the first nozzle row is notated as a nozzle row 33M1, and a row corresponding to the second nozzle row is notated as a nozzle row 33M2. In the same color nozzle rows group of the Y ink, a row corresponding to the first nozzle row is notated as a nozzle row 33Y1, and a row corresponding to the second nozzle row is notated as a nozzle row 33Y2. In the same color nozzle rows group of the K ink, a row corresponding to the first nozzle row is notated as a nozzle row 33K1, and a row corresponding to the second nozzle row is notated as a nozzle row 33K2.

The first nozzle row and the second nozzle row constituting the same color nozzle rows group are arranged in a state in which positions thereof are deviated from each other as a distance of half of the nozzle pitch NP in the nozzle row direction D3. Accordingly, the nozzle resolution (the number of nozzles per 1 inch) in the transportation direction D2 due to the same color nozzle rows group is a multiple of the nozzle resolution in the transportation direction D2 due to any one of the first nozzle row or the second nozzle row. As illustrated in the example of FIG. 3, when the nozzle row direction D3 and the transportation direction D2 are parallel to each other, the nozzle pitch in the transportation direction D2 due to the same color nozzle rows group is NP/2.

The carriage 35 on which the printing head 31 is mounted receives a motivity of a carriage motor (not illustrated), and is moved parallel to the main scanning direction D1. The printing head 31 is moved together with the carriage 35 and discharges the ink onto the printing medium S so as to realize printing. A process, in which the printing head 31 discharges the ink according to a movement from one end side of the main scanning direction D1 to the other end side thereof, or a movement from the other side of the main scanning direction D1 to one end side thereof, is referred to as "main scanning" or "pass" at one time. According to such a configuration, the printing control apparatus 10 moves the printing head 31 in the main scanning direction D1 intersecting with the nozzle row direction D3 so as to discharge the ink from the nozzles 34. The printing head includes at least the first nozzle row in which the plurality of nozzles 34 capable of discharging the same kind of ink are arranged in the nozzle row direction D3, and the second nozzle row in which the plurality of nozzles 34 capable of discharging the same kind of ink are arranged in the nozzle row direction D3.

Hereinafter, for convenience of description, the left side LS is defined as one end side of the main scanning direction D1, the right side RL is defined as the other end side of the main scanning direction D1, a movement from the left side LS to the right side RS due to the carriage 35 (printing head 31) is defined as a main passage movement, and a movement from the right side RS to the left side LS is defined as a return passage movement. Of course, a definition of the main passage and return passage may be reversed. In addition, one nozzle row of the first nozzle row and the second nozzle row, which precedes at the time of moving the printing head 31 (front side at the time of moving), is referred to as a preceding nozzle row, and the other nozzle row thereof which is followed at the time of moving the printing head (rear side at the time of moving) is referred to as a following nozzle row. A positional relationship of the preceding nozzle row and the following nozzle row is, of course, switched into a main passage movement and a return passage movement. For example, in the same color nozzle rows group of the C ink, as known from FIG. 3, in the main passage movement, the nozzle row 33C2 (second nozzle row) becomes the preceding nozzle row, and the nozzle row 33C1 (first nozzle row) becomes the following nozzle row. On the other hand, in the return passage movement, the nozzle row 33C1 (first nozzle row) becomes the preceding nozzle row, and the nozzle row 33C2 (second nozzle row) becomes the following nozzle row. The same manner is also applied to the same color nozzle rows group of the other inks.

2. Generation of Printing Data

Figure 4:
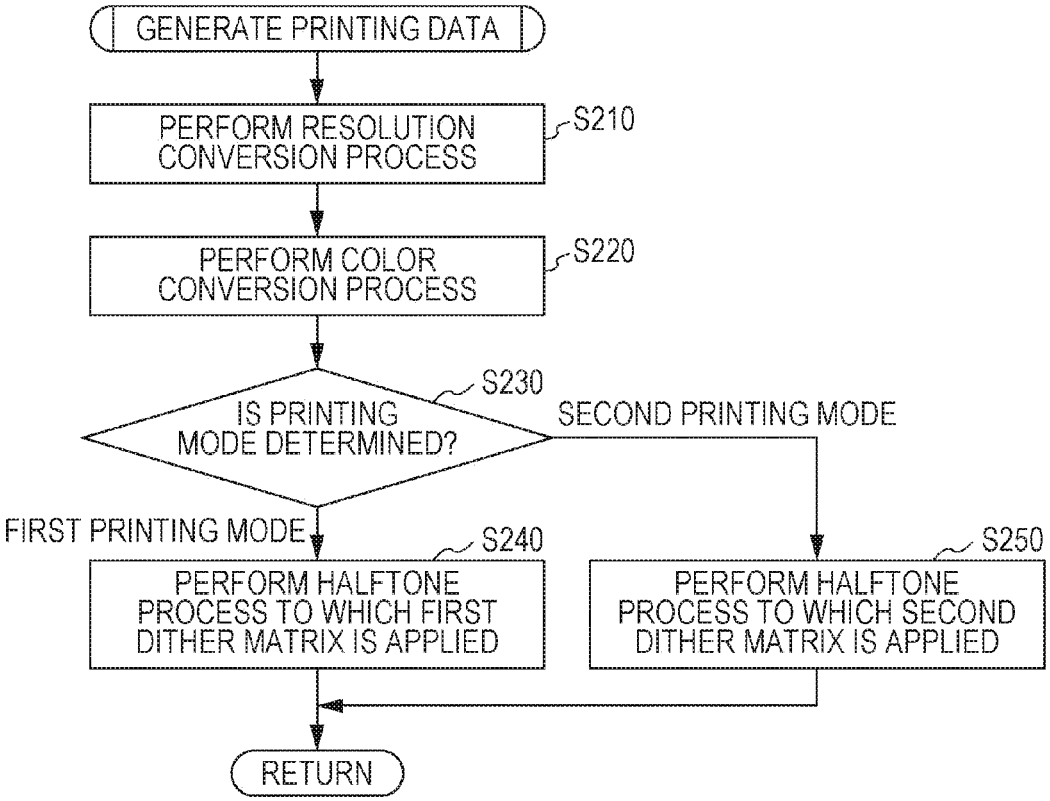
FIG. 4 is a flow chart illustrating a process of generating of printing data.

In FIG. 4, Step S200 (generation of printing data) in FIG. 2 is illustrated in detail by a flow chart.

In Step S210, the control section 11 performs the resolution conversion process on the image data, and then makes each resolution (dpi) of length and breadth thereof match each of printing resolution of the main scanning direction D1 and the transportation direction D2, which are applied by the printing section 30.

Next, in Step S220, the control section 11 performs the color conversion process on the image data after Step S210, and then converts each density of the CMYK ink in each pixel into the image data expressed by a gradation (for example, 256 gradation from 0 to 255). The color conversion process can be performed by defining a conversion relationship of the RGB and the CMYK with reference to a lookup table, or the like which is stored in the predetermined memory in advance.

In Step S230, the control section 11 determines whether or not a printing mode, which is currently set, is a first printing mode or a second printing mode, and if it is the first printing mode, a process precedes to Step S240, and if it is the second printing mode, the process precedes to Step S250.

Here, the first printing mode means a printing mode in which wind ripple is likely to be generated, and the second printing mode means a printing mode in which wind ripple is less likely to be generated (at least more than first printing mode). The printing mode is a behavior which is applied by the printing section 30 at the time of performing printing, and if the printing mode is different, the behavior is also different.

The user, for example, can arbitrarily set the printing mode by operating the operation input section 16 while seeing a user interface (UI) screen displayed on the display section 17, and the control section 11 performs printing due to the behavior of the printing section 30 corresponding to the set printing mode. The user can simply set the printing mode, for example, by selecting a desired condition in a menu in the UI screen (menu relating to image quality such as "clear (high quality)" or "normal", menu relating to selection of printing medium such as "normal paper", "gloss paper", or "envelope", menu for selecting "single-surface printing" or "double-surface printing", and the like).

Moreover, a specific difference between the first printing mode and the second printing mode will be described later, and here, a flow chart of FIG. 4 will be continuously described.

The control section 11 generates the printing data by performing the halftone process on the image data in any one of Steps S240 and S250 after Step S220. The halftone process is performed by a dither method using a dither matrix. That is, the dither matrix including a plurality of threshold values corresponding to each pixel is applied to the image data in which the density of the CMYK ink expressed by the gradation in each pixel constituting an image, and the printing data which determines discharging or non-discharging of the ink in each pixel is generated. In this case, when a gradation value expressing a density of the ink of any color of any pixel is higher than the threshold value corresponding to the pixel in the dither matrix, discharging (ON of dots) of the ink of the color of the pixel is determined, and when the gradation value is equal to or lower than the threshold value, non-discharging (OFF of dots) of the ink of the color of the pixel is determined. In Step S240 and Step S250, the dither matrix being used is different. Hereinafter, a dither matrix used in Step S240, that is, the dither matrix which is applied in a case of the first printing mode is referred to as a first dither matrix, and a dither matrix used in Step S250, that is, the dither matrix which is applied in a case of the second printing mode is referred to as a second dither matrix. The dither matrix is stored, for example, in the predetermined memory in advance.

Before describing the first dither matrix and the second dither matrix, a relationship between the nozzle 34 and the pixel allocated to the nozzle 34 will be described.

Figure 5:
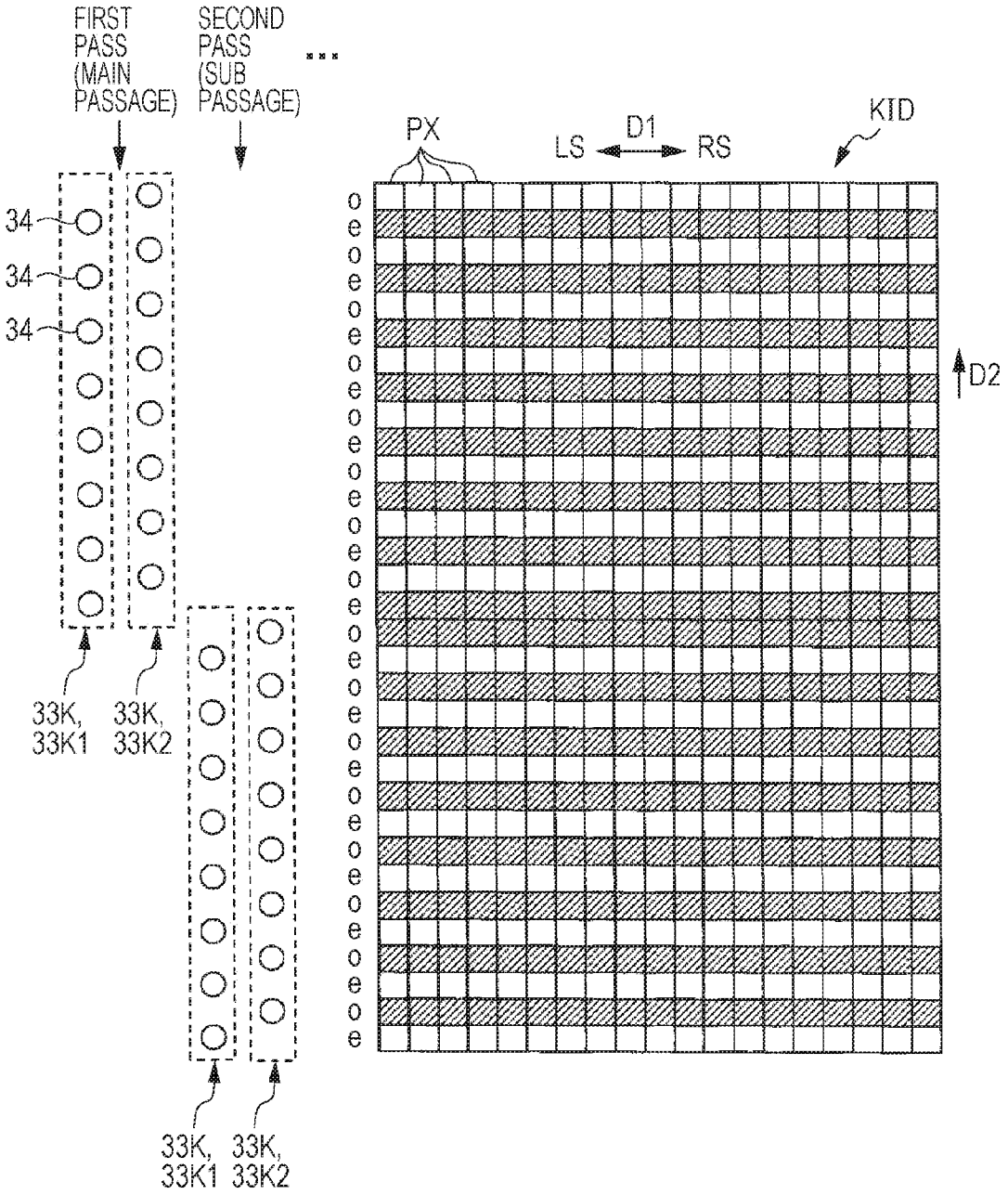
FIG. 5 is a diagram illustrating an example of a corresponding relationship of a nozzle and a pixel.

FIG. 5 illustrates an example of corresponding relationship between the nozzle 34 and the pixel allocated to the nozzle 34. In FIG. 5, one same color nozzle rows group (as an example, the nozzle rows 33K1 and 33K2 constituting the same color nozzle rows group of K ink) among the plurality of nozzles illustrated in FIG. 3 is extracted and illustrated, and a part of image data KID (image data in which density of K ink is expressed by gradation in each pixel), which is allocated to the nozzle rows 33K1 and 33K2, in the image data obtained in Step S220 is illustrated. A plurality of pixels PX, which are arranged to be respectively corresponded to the main scanning direction D1 and the transportation direction D2, constitute the image data. For convenience of description, a direction of an arrangement of the pixels constituting the image data is expressed by a direction D1 or D2, but it is only based on a corresponding (matching) relationship between a direction of an image and the directions D1 and D2 at the time of performing printing using the printing section 30. In FIG. 3 and FIG. 5, the number of nozzles 34 constituting one nozzle row is eight, but this is only exemplified, in actual, one nozzle row is constituted many nozzles 34 (for example, substantially 180 nozzles).

In FIG. 5, as a printing method which is performed by the printing section 30, when band printing in a two-way direction is applied, an allocation relationship of the nozzle 34 and the pixel is illustrated. First, printing in two-way direction (bidirectional printing) means printing in which the ink is discharged in both of the main passage movement and the return passage movement. In addition, the band printing is schematically a printing method in which a bundle (band) of a raster line as the number of nozzles 34 (8×2=16, in FIG. 3 and FIG. 5) constituting the same color nozzle rows group is printed on first pass of the printing head 31, and such a pass and a transportation (feeding) of a printing medium S as a length (predetermined distance) in the transportation direction D2 of the band are alternatively repeated. Accordingly, in the band printing in two-way direction, a process is repeated in order of printing→feeding of one band by a pass of the main passage movement→printing→feeding of next band by a pass of the return passage movement→next band by a pass of the main passage movement.

The raster line is a region illustrated as an aggregation (hereinafter, referred to as pixel row) of the plurality of pixels PX continuous in the main scanning direction D1, and one raster line is printed by one nozzle 34 in the band printing. Of course, the printing method applied to the printing section 30 is not limited to the band printing in a two-way direction; however, when the printing method is determined even in any the printing method, the control section 11 is capable of determining that which pixel constituting the image data is allocated to which nozzle 34. FIG. 5 illustrates that a position (relative position of image data KID in transportation direction D2) of the same color nozzle rows group is changed in each pass (first pass, second pass, and the like) by the printing head 31. Of course, in actual, the printing head 31 does not move in the transportation direction D2, whenever the pass is terminated, the printing medium S is fed as a predetermined distance by the transportation section 36 in the transportation direction D2, and information relating to a pixel a band to be printed in next pass is allocated to the nozzle 34.

Further, in FIG. 5, for convenience of description, symbols o and e are alternatively given to each of pixel row in the transportation direction D2, one by one. A pixel row given the symbol o is, for example, a first, third, fifth, and the like of a pixel row counted from a front side of the transportation direction D2, and corresponds to the raster line (raster line in an odd-numbered position) corresponding to odd-numbered positions in the transportation direction D2 (or nozzle row direction D3) in the image data. Meanwhile, a pixel row given the symbol e corresponds to the raster line (raster line in an even-numbered position) corresponding to even-numbered positions in the transportation direction D2 (or nozzle row direction D3) in the image data. According to an example of FIG. 5, in the pass of the main passage movement, a group of the odd-numbered position raster lines is printed by the preceding nozzle row (nozzle row 33K2), and a group of the even-numbered position raster lines is printed by the following nozzle row (nozzle row 33K1). Meanwhile, in the pass of the return passage movement, the group of the even-numbered position raster lines is printed by the preceding nozzle row (nozzle row 33K1), and the group of the odd-numbered position raster lines is printed by the following nozzle row (nozzle row 33K2).

Further, in FIG. 5, each of the pixel rows is divided into a pixel row expressed by a rectangular (pixel PX) in which hatching is performed and a pixel row expressed by a rectangular (pixel PX) in which hatching is not performed. The non-hatching pixel row indicates a group of the raster lines (group of raster lines in one side in claims) which is printed by the preceding nozzle row, and the hatching pixel row indicates a group of the raster lines (group of raster lines in the other side in claims) which is printed by the following nozzle row. Since, in the main passage movement and the return passage movement, the preceding nozzle row and the following nozzle row in the same color nozzle rows group are switched, when the group of the even-numbered position raster lines is printed in the following nozzle row at the time of the main passage movement, the group of the odd-numbered position raster lines is printed in the following nozzle row at the time of the return passage movement (in the same way, when the group of the odd-numbered position raster lines is printed in the following nozzle row at the time of the main passage movement, the group of the even-numbered position raster lines is printed in the following nozzle row at the time of the return passage movement).

Figure 6A:
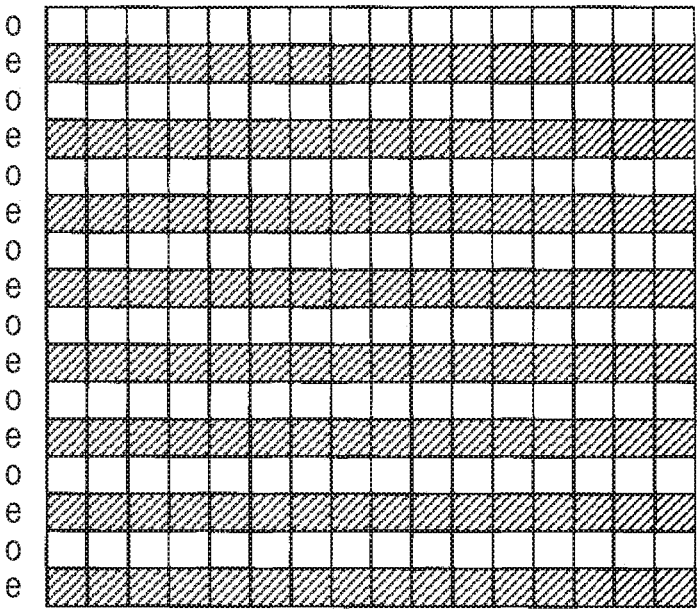
FIGS. 6A and 6B are diagrams schematically exemplifying a dither matrix.
Figure 6B:
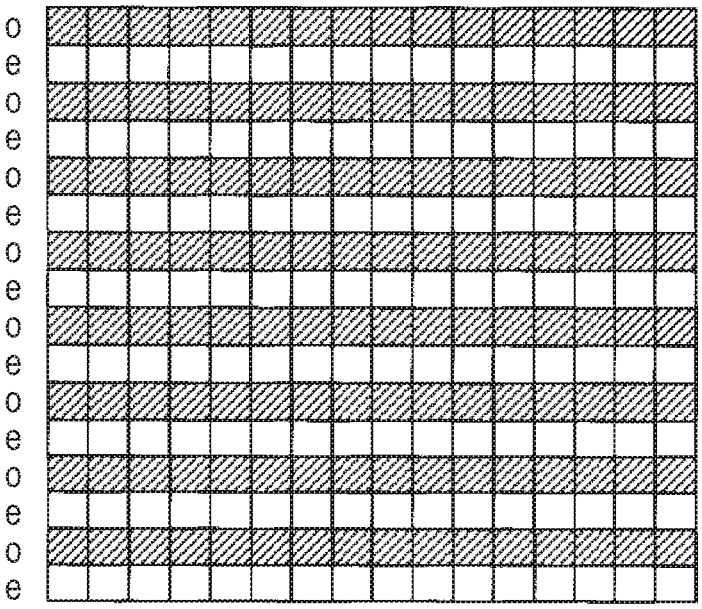

Both FIGS. 6A and 6B schematically exemplify the first dither matrix used in Step S240. The dither matrix DM1 (a type of first dither matrix) illustrated in FIG. 6A is a dither matrix used for an image region which is printed by a pass of the main passage movement of the K ink in the image data (for example, the upper half region of the image data KID illustrated in FIG. 5). Meanwhile, a dither matrix DM2 (a type of first dither matrix) illustrated in FIG. 6B is a dither matrix used for an image region which is printed by a pass of the return passage movement of the K ink in the image data (for example, the lower half region of the image data KID illustrated in FIG. 5). One threshold value is stored in each of the rectangle constituting the dither matrixes DM1 and DM2.

As we know, the dither matrix is a matrix in which a plurality of different threshold values for binarizing a density of the ink expressed by various gradations are arranged in a two-dimensional shape. When each of the pixels of the image data obtained in Step S220 as described above expresses the density of the ink by the 256 gradations, the dither matrix allows, for example, each value of 0 to 255 (each threshold value) to be arranged in a two-dimensional shape.

Here, compared to the second dither matrix used in Step S250, the first dither matrix (dither matrixes DM1 and DM2) is a dither matrix in which low values are distributed to a plurality of threshold values corresponding to each pixel expressing the group of the raster lines printed in the following nozzle row more than a plurality of threshold values corresponding to each pixel expressing the group of the raster lines printed in the preceding nozzle row. As illustrated in FIGS. 6A and 6B, the same way as FIG. 5 is performed on the dither matrixes DM1 and DM2, for convenience of description, the symbol o is given to odd-numbered row, and the symbol e is given to even-numbered row. In addition, in the dither matrixes DM1 and DM2, each row without hatching is a row (preceding nozzle-applied row) which is applied (overlapped) to each pixel row expressing the group of the raster lines printed using the preceding nozzle row, and each row with hatching is a row (following nozzle-applied row) which is applied (overlapped) to each pixel row expressing the group of the raster lines printed using the following nozzle row. As illustrated in FIG. 6A, the even-numbered row is the following nozzle-applied row in the dither matrix DM1. On the other hand, as illustrated in FIG. 6B, the odd-numbered row is the following nozzle-applied row in the dither matrix DM2.

In the dither matrixes DM1 and DM2, for example, the threshold values of 0 to 255 is divided into the lower gradation range (each threshold value of 0 to 127) and the high gradation range (each threshold value of 128 to 255), the dither matrixes has a configuration in which each threshold value of the lower gradation range is arranged arbitrarily by being limited within the following nozzle-applied row, and each threshold value of the high gradation range is arranged arbitrarily by being limited in the preceding nozzle-applied row. Accordingly, the dither matrixes DM1 and DM2 become a state in which relative lower threshold values are distributed to the following nozzle-applied row. In both of the dither matrixes DM1 and DM2, the relative lower threshold values are distributed to the following nozzle-applied row; however, a position of the following nozzle-applied row, one side thereof is an odd numbered-row, and the other side is an even-numbered row, therefore, these are different dither matrixes.

Meanwhile, the second dither matrix used in Step S250 is a dither matrix in which the threshold values are not distributed (or distributed little) as described above. For example, the second dither matrix is a dither matrix in which the threshold values of 0 to 255, which are not distributed by the preceding nozzle-applied row or the following nozzle-applied row, are arbitrarily arranged in a matrix. Accordingly, regarding the second dither matrix, when an average value of the threshold values in the preceding nozzle-applied row and an average value of the threshold values in the following nozzle-applied row are calculated, the two average values are barely the same value, but the values are varied close to each other. That is, in the second dither matrix, the plurality of threshold values corresponding to each pixel expressing the group of the raster lines printed using the preceding nozzle row, and the plurality of threshold values corresponding to each pixel expressing the group of the raster lines printed using the following nozzle row, respectively evenly include the threshold values belong to the lower gradation range and the threshold values belong to the higher gradation range.

In Step S240, the control section 11 binarizes a density of the K ink of each pixel constituting an image region by applying the dither matrix DM1 to the image region printed in the pass of the main passage movement of the image data KID. In the same manner, the control section 11 binarizes the density of the K ink of each pixel constituting the image region by applying the dither matrix DM2 to the image region printed in the pass of the return passage movement of the image data KID. By a halftone process to which such a first dither matrix (dither matrixes DM1 and DM2) is applied, the printing data is generated. Meanwhile, in Step S250, the control section 11 binarizes the density of the K ink of each pixel by applying the second dither matrix to the image data KID. By the halftone process to which such a second dither matrix is applied, the printing data is generated.

In Step S240 or Step S250, of course, the halftone process is respectively performed on each of image data (image data in which density of the C ink is expressed by gradation in each pixel) allocated to the nozzle rows 33C1 and 33C2, image data (image data in which density of the M ink is expressed by gradation in each pixel) allocated to the nozzle rows 33M1 and 33M2, and image data (image data in which density of the Y ink is expressed by gradation in each pixel) allocated to the nozzle rows 33Y1 and 33Y2, in the image data obtained in Step S220. In Step S240, with respect to each of the image data of the CMYK ink, a dither matrix applied for the image region printed by the pass of the main passage movement and a dither matrix applied for the image region printed by the pass of the return passage movement are respectively required to be used. However, when referring to the example of FIG. 3, the nozzle rows 33M1 and 33M2 of the M ink have the same relative position relationship of the first nozzle row and the second nozzle row in the nozzle row direction D3 as that of the nozzle rows 33K1 and 33K2 of the K ink (second nozzle row of right side RS is deviated toward front side of the transportation direction D2 as NP/2). Accordingly, as the first dither matrix applied to the image data of the M ink, the dither matrix DM1 for the image region printed by the pass of the main passage movement can be adopted, and the dither matrix DM2 for the image region printed by the pass of the return passage movement can be adopted.

Meanwhile, the nozzle rows 33C1 and 33C2 of the C ink, and the nozzle rows 33Y1 and 33Y2 of the Y ink have a relative position relationship of the first nozzle row and the second nozzle row in the nozzle row direction D3, which is reversed to that of the nozzle rows 33K1 and 33K2 of the K ink (first nozzle row of left side LS is deviated toward front side of transportation direction D2 as NP/2). Accordingly, as the first dither matrix which is applied to the image data of the C ink and the image data of the Y ink, the dither matrix DM2 for the image region printed by the pass of the return passage movement can be adopted, and the dither matrix DM1 for the image region printed by the pass of the return passage movement can be adopted.

Moreover, in Step S250, the second dither matrix may be applied to each of the image data of the CMYK ink.

In the printing data generated by the halftone process of Step S240, based on a distribution of the threshold values in the first dither matrix described above, the number of pixels in which dot ON is determined in the pixels expressing the group of the raster lines printed by the following nozzle row are greater than the number of pixels in which dot ON is determined in the pixels expressing the group of the raster lines printed by the preceding nozzle row. Accordingly, according to the printing data generated by the halftone process of Step S240, when the printing head 31 discharges the ink, a relationship of an amount of the ink discharged from the following nozzle row>an amount of the ink discharged from the preceding nozzle row, is satisfied. The amount of ink described here, for example, is obtained by an expression of the number of dots discharged from the nozzle row x an ink volume (or weight) per one dot. Meanwhile, when the printing data is generated by the halftone process of Step S250, the threshold values are not distributed (barely distributed) to the second dither matrix. For this reason, almost same number of the preceding nozzle row and the following nozzle row are used, and thus, a difference between the amount of the ink discharged from the following nozzle row and the amount of the ink discharged from the preceding nozzle row is very small. That is, when a first printing mode is adopted, a ratio of the amount of the ink discharged from the following nozzle row with respect to the amount of the ink discharged from the preceding nozzle row becomes greater than a ratio thereof when a second printing mode is adopted.

3. Examples of First and Second Printing Modes

Next, some examples with respect to the first printing mode and the second printing mode will be described.

Example 1

The printing mode in which a PG, which is a distance, from a platen 32 which supports the printing medium S to the printing head 31 is wider than the PG in the second printing mode corresponds to one first printing mode.

Figure 7:
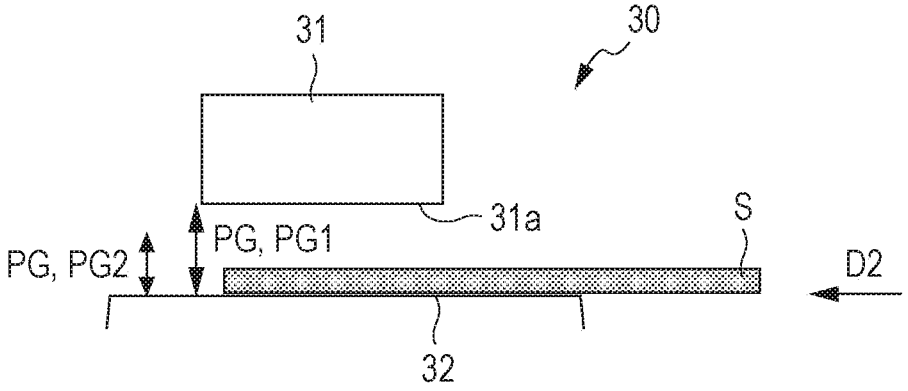
FIG. 7 is a diagram simply illustrating a configuration of a part of a range of a printing section when seen from a side.

FIG. 7 simply illustrates a configuration of a part of a range of the printing section 30 when seen from a side. In the printing section 30, the platen 32 is provided to correspond to the ink discharging surface 31*a* of the printing head 31. The printing medium S is transported onto the platen 32 in the transportation direction D2 by the transportation section 36. In FIG. 7, the main scanning direction D1 is a direction perpendicular to a surface of a paper of the drawing. As is known, the printing section 30 is capable of adjusting a height from the platen 32 to the printing head 31 (ink discharging surface 31*a*), that is, the PG, by adjusting a position of a height direction of the carriage 35, or the like.

For example, the control section 11 allows the printing section 30 to change setting of the PG so that a normal PG (hereinafter, PG2) is changed to a wider PG (hereinafter, PG1), when double-surface printing is set, or a relatively thick medium (for example, envelope) is set as the printing medium S, in order to prevent contact between the ink discharging surface 31*a* of the printing head 31 and the printing medium S. Accordingly, the printing mode to which the PG2 is adopted corresponds to an example of the second printing mode, and the printing mode to which the PG1 wider than the PG2 is adopted corresponds to an example of a printing motor in which wind ripple is likely to be generated, that is, the first printing mode. When the PG is wide, a flight duration of the ink discharged from the nozzles 34 to be landed onto the printing medium S is easily extended, and thus, a landing position of the discharged ink is likely to be deviated due to an effect such as eddy air current (as a result, wind ripple is likely to be generated). According to Example 1, the control section 11 performs the halftone process to which the first dither matrix is applied when the printing mode adopts the PG1 (Step S240), performs the halftone process to which the second dither matrix is applied when the printing mode adopts the PG2 (Step S250).

Example 2

The printing mode having a characteristic, in which the ink is less likely to be blurred in the printing medium S being used (first printing medium) than the printing medium S (second printing medium) being used in the second printing mode, corresponds to one first printing mode. Being easily blurred and not easily blurred of the ink affect to the wind ripple. When a deviation occurs in the landed position of the ink due to an effect such as the eddy air current, since the landed ink is relatively widen (blurred) on the printing medium S where the ink is likely to be blurred, color unevenness is suppressed (wind ripple is not easily seen); however, since the landed ink is barely widen on the printing medium S where the ink is less likely to be blurred, the wind ripple is easily seen. For example, gloss paper corresponds to the first printing medium because the ink is less likely to be blurred, relatively, and normal paper corresponds to the second printing medium because the ink is likely to be blurred.

Accordingly, the printing mode which adopts the normal paper as the printing medium S corresponds to an example of the second printing mode, and the printing mode which adopts the gloss paper as the printing medium S corresponds to an example of the first printing mode. However, a specific example of the first printing medium and the second printing medium is not limited to the gloss paper and the normal paper. The control section 11 has information of identifying various types of the printing mediums S which can be used by the printing section 30 as the first printing medium and the second printing medium according to characteristics thereof. According to Example 2, the control section 11 performs the halftone process to which the first dither matrix is applied when the printing mode adopts one printing medium S included in the first printing medium (Step S240), and performs the halftone process to which the second dither matrix is applied when the printing mode adopting one printing medium S included in the second printing medium (Step S250).

Example 3

The printing mode, in which the printing resolution (first printing resolution) of the main scanning direction D1 therein is set to be higher than the printing resolution (second printing resolution) of the main scanning direction D1 in the second printing mode, corresponds to one first printing mode. The printing resolution of the main scanning direction D1 affects the wind ripple. As much as the printing resolution is high, a time when the one nozzle 34 discharges the ink and then performs next discharging is likely to be short, therefore, regarding the ink discharged from the nozzle 34, the landed position is likely to be deviated by being strongly affected the eddy air current which occurs at the time of discharging of the ink performed previously (as a result, wind ripple is likely to be generated).

As the printing resolution of the main scanning direction D1, the printing section 30 can adopt one of setting out of a plurality of printing resolutions, for example, 720 dpi or 1440 dpi. For example, when the "clear (high quality)" is selected relating to the image quality, the control section 11 allows the printing section 30 to adopt a higher value, as the printing resolution of the main scanning direction D1 (first printing resolution), than that of the printing resolution of the main scanning direction D1 (second printing resolution) adopted when the "normal" is selected relating to the image quality. Accordingly, the printing mode of a case in which the "clear (high quality)" is selected relating to the image quality corresponds to an example of the first printing mode, and the printing mode of a case in which the "normal" is selected relating to the image quality corresponds to an example of the second printing mode.

The control section 11 includes, for example, a predetermined threshold value relating to the printing resolution of the main scanning direction D1. The resolution higher than the threshold value is set to the first printing resolution, and the resolution lower than the threshold value is set to the second printing resolution. In addition, according to Example 3, when the printing mode adopts the first printing resolution as the printing resolution of the main scanning direction D1, the control section 11 performs the halftone process to which the first dither matrix is applied (Step S240), and when the printing mode adopts the second printing resolution as the printing resolution of the main scanning direction D1, the control section 11 performs the halftone process to which the second dither matrix is applied (Step S250).

4. Outline

According to the embodiment, a ratio of the amount of the ink discharged from the following nozzle row with respect to the amount of the ink discharged from the preceding nozzle row can be different from each other because of the printing mode. For this reason, the ratio can be great when comparing the first printing mode in which the wind ripple is likely to be generated relatively with a printing mode (second printing mode) in which the wind ripple is less likely to be generated. In at least the first printing mode, it becomes an amount of the ink discharged from the following nozzle row>an amount of the ink discharged from the preceding nozzle row. Accordingly, when the following nozzle row discharges the ink, air wall (air wall generated according to discharging of the ink by preceding nozzle row), which becomes a cause for inhibiting air current from a front side of the movement of the printing head 31, is reduced, and generation of the eddy air current when the following nozzle row discharges the ink accurately suppressed. As a result, in the first printing mode in which the wind ripple is likely to be generated, a deviation of the landed position of the ink discharged from the following nozzle row is suppressed, and a good printed result with less wind ripple is obtained.

Meanwhile, in the second printing mode in which the wind ripple is less likely to be generated, a process for setting a relationship of an amount of the ink discharged from the following nozzle row>an amount of the ink discharged from the preceding nozzle row is basically not performed because a demand thereof is low. For this reason, an event can be avoided in which the image is unnecessarily deteriorated due to distribution of the usage ratio of the preceding nozzle row to the following nozzle row in a state in which the wind ripple is less likely to be generated.

5. Modification Example

The invention is not limited to the above described embodiment, and can be performed in accordance with aspects within a range which does not depart from a gist thereof, for example, modification examples to be described below can be adopted. A configuration in which the embodiment described above and modification examples are appropriately combined is included in a disclosure range of the invention. In description of the modification examples hereinbelow, description of common issues same as the above described embodiment will not be repeated.

Modification Example 1

For example, when the threshold values of 0 to 255 are divided into half, a first dither matrix (dither matrixes DM1 and DM2) used in Step S240 has a configuration in which a lower gradation range (each of threshold values of 0 to 127) is arranged by being limited within a following nozzle-applied row, and a high gradation range (each of threshold values of 128 to 255) is arranged by being limited within the preceding nozzle-applied row. In such a first dither matrix, when an image is expressed by pixels having a density of ink equal to or less than 50% (pixel having gradation value of any one in range (0 to 127) of a lower side of 50% in gradation range of 0 to 255), dots to be formed are formed using all of the following nozzle rows. The first dither matrix is also referred to as a dither matrix corresponding to a distribution of a duty (ink density) 50%. The dither matrix corresponding to a distribution of the duty 50%, is a dither matrix in which the threshold values of a lower side are distributed to the following nozzle-applied row as much as possible.

In Modification example 1, it is proposed that a degree of such a distribution is varied according to a case in which the wind ripple is likely to be generated. Specifically, other than the dither matrix corresponding to the distribution of duty 50%, a plurality of dither matrixes such as a dither matrix corresponding to the distribution of duty 40% and a dither matrix corresponding to the distribution of duty 30% can be used. The dither matrix corresponding to the distribution of duty 40% has a configuration in which 40% degrees of a lower side of the threshold values from 0 to 255 (for example, each of threshold values from 0 to 102) are arranged by being limited within the following nozzle-applied row, and the rest of the threshold values (each of threshold values from 103 to 255) are arranged by being limited within a position where the threshold values are not stored in the following nozzle-applied row and within the preceding nozzle-applied row. In addition, the dither matrix corresponding to the distribution of duty 30% has a configuration in which 30% degrees of a lower side of the threshold values from 0 to 255 (for example, each of threshold values from 0 to 76) are arranged by being limited within the following nozzle-applied row, and the rest of the threshold values (each of threshold values from 77 to 255) are arranged by being limited within a position where the threshold values are not stored in the following nozzle-applied row and within the preceding nozzle-applied row.

In addition, it can be said that the second dither matrix used in Step S250 is a dither matrix corresponding to the distribution of duty 0%. However, it does not mean that the second dither matrix is not allowed the distribution at all. For example, the second dither matrix may be a dither matrix corresponding to the distribution of duty 10% degree.

In a case in which Example 1 is assumed, in Step S240, the control section 11 performs the halftone process using the first dither matrix in which a degree of distribution is high, as much as the PG1 which is set in the printing mode (first printing mode) at this time is wide. For example, the PG1 which is wider than the PG2 is set to be another PG which becomes a first PG, a second PG, and a third PG according to the printing mode. Here, the first PG>the second PG>the third PG>PG2. For example, the control section 11 adopts the dither matrix corresponding to the distribution of duty 50% as the first dither matrix when the PG1 is the first PG set in the first printing mode, adopts the dither matrix corresponding to the distribution of duty 40% as the first dither matrix when the PG1 is the second PG, and adopts the dither matrix corresponding to the distribution of duty 30% as the first dither matrix when the PG1 is the third PG.

Also, when Example 2 is assumed, in Step S240, the control section 11 performs the halftone process using the first dither matrix in which the degree of distribution is high, as much as the printing medium S, which is used in the printing mode (first printing mode) at this time, is a medium where the ink is less likely to be blurred. Specifically, the control section 11 divides various types of the printing mediums corresponding to the first printing medium into a plurality of groups according to a case in which the ink is less likely to be blurred, in advance. In addition, the dither matrix corresponding to the distribution of duty 50% as the first dither matrix is adopted when the first printing medium adopted in the first printing mode is a medium in a group of the printing mediums in which the ink is the most difficult to be blurred, the dither matrix corresponding to the distribution of duty 40% as the first dither matrix is adopted when it is a medium in a group of the printing mediums in which the ink is the second-most difficult to be blurred, and the dither matrix corresponding to the distribution of duty 30% as the first dither matrix is adopted when it is a medium in a group of the printing mediums in which the ink is the third-most difficult to be blurred. The dither matrix which is used according to characteristics of the printing medium S is changed as described above.

In addition, when Example 3 is assumed, in Step S240, the control section 11 performs the halftone process using the first dither matrix in which the degree of distribution is high, as much as the printing resolution of the main scanning direction D1 which is set in the printing mode (first printing mode) at this time is high. For example, in the first printing mode, the control section 11 sets one printing resolution out of the plurality of the printing resolutions corresponding to the first printing resolution as the printing resolution of the main scanning direction D1. Also, the dither matrix corresponding to the distribution of duty 50% is adopted as the first dither matrix when the printing resolution of the main scanning direction D1 set in the first printing mode is the highest value in the plurality of printing resolutions, the dither matrix corresponding to the distribution of duty 40% is adopted as the first dither matrix when it is the second-highest value in the plurality of printing resolutions, and the dither matrix corresponding to the distribution of duty 30% is adopted as the first dither matrix when it is the third-highest value in the plurality of printing resolutions. The dither matrix which is used according to the printing resolution of the main scanning direction D1 is changed as described above.

According to Modification example 1, a degree of distribution in the first dither matrix is varied according to a case in which the wind ripple is likely to be generated (width of PG, difficulty of blurring of ink in the printing medium S, or height of the printing resolution of the main scanning direction D1). Accordingly, while the wind ripple is appropriately suppressed, unnecessary distribution can be suppressed to be generated in a usage ratio of the preceding nozzle row and the following nozzle row.

Modification Example 2

In Step S240, the control section 11 may perform the halftone process in each of the image data of the CMYK ink using a different first dither matrix which is changed. For example, since visibility of color unevenness is different in each color of the ink, regarding a color in which color unevenness (wind ripple) is barely seen due to a deviation of the landed position, a degree of the distribution in the first dither matrix can be lowered. For example, even when a deviation is generated in the landed position of a relatively light color such as the Y ink among the CMYK ink, a user barely recognizes such a deviation. Here, in Step S240, for example, when a dither matrix corresponding to the distribution of duty 50% as the first dither matrix may be adopted in each of the image data of the CMK ink, a dither matrix corresponding to the distribution of duty 30% as the first dither matrix is adopted in each of the image data of the Y ink, or the like.

Otherwise, the control section 11 may perform the halftone process by applying the second dither matrix to the image data of the Y ink without considering the printing mode (both of Steps S240 and S250). In addition, the control section 11 can apply a different first dither matrix to each of the image data of the CMK ink.

Modification Example 3

In a description with reference to FIGS. 5 and 6, the printing section 30 performs bidirectional printing; however, it may perform single direction printing. The single direction printing means printing in which the ink is discharged by either of the main passage movement and the return passage movement (for example, by only main passage movement). When performing the single direction printing, in the first dither matrix used for the halftone process of Step S240, in a case of focusing one color ink, any one of the dither matrixes DM1 and DM2 is needed. For example, when the ink is discharged by only the main passage movement, regarding the nozzle rows 33K1 and 33K2 of the K ink, generally, the nozzle row 33K2 is the preceding nozzle row, and the nozzle row 33K1 is the following nozzle row. Accordingly, when performing the halftone process on the image data of the K ink in Step S240, only the dither matrix DM1 illustrated in FIG. 6A is needed as the first dither matrix.

Modification Example 4

In a case of the first printing mode, a unit, which is used for satisfying a relationship of an amount of the ink discharged from the following nozzle row>an amount of the ink discharged from the preceding nozzle row, is not limited to the halftone process using the dither matrix (first dither matrix) as described above. For example, when the printing mode is determined to be the first printing mode in Step S230, in the image data generated in Step S220, the control section 11 corrects each of pixel rows expressing the group of the raster lines printed using the following nozzle row as a target so as to increase a density of the ink (gradation value). Meanwhile, in the image data, the control section 11 corrects each of pixel rows expressing the group of the raster lines printed using the preceding nozzle row as a target so as to decrease a density of the ink (gradation value). In this case, the halftone process is not need to be branched to Step S240, S250, and simply, the printing data may be generated by applying the second dither matrix to the image data after correction.

Otherwise, when the printing mode is determined as the first printing mode in Step S230, the control section 11 simply performs the halftone process to which the second dither matrix is applied on the image data generated in Step S220 without performing the correction, and then adding and thinning of dots may be performed. For example, the control section 11 corrects each of the pixel rows expressing the group of the raster lines printed using the following nozzle row as a target, so as to increase the number of pixels for ON of dots, in the printing data generated by the halftone process. Meanwhile, in the printing data, the control section 11 may correct each of the pixel rows expressing the group of the raster lines printed using the preceding nozzle row as a target, so as to decrease the number of pixels for ON of dots.

Modification Example 5

The nozzles 34 included in the printing head 31 are capable of discharging ink droplets of various sizes. For example, the nozzles 34 are capable of discharging three types of ink droplets (ink droplets which are referred to as a large dot, a middle dot, a small dot, or the like based on a relative difference of volume per one drop). In this case, the printing data generated in Step S200 is not simply information of two values of ON and OFF of dots, but is information of four values illustrating ON and OFF of a dot of the large dot, the middle dot, and the small dot. That is, in the halftone process (Step S240 or Step S250), the control section 11 converts a density of the ink (information expressed by 256 gradations) into information expressed by four gradations in each of the CMYK and in each pixel. At this time, in Step S240, in the image data generated in Step S220, the control section 11 allocates large, middle, and small sizes of dots to each of pixels so as to generate dots in each of the pixels constituting each of the pixel rows expressing the group of the raster lines printed using the following nozzle row, greater than each of the pixel constituting each of the pixel rows expressing the group of the raster lines printed using the preceding nozzle row. Moreover, at the time of allocating, the number of dots is counted by considering a size ratio of the large dot, the middle dot, and the small dot. For example, in a case in which one large dot is counted as one dot when the number of dots is counted, one middle dot is counted as 0.5 dots, and one small dot is counted as 0.25 dots, or the like.

The entire disclosure of Japanese Patent Application No. 2015-053041, filed Mar. 17, 2015 is expressly incorporated by reference herein.

What is claimed is:

1. A printing control apparatus which discharges ink from nozzles, while moving a printing head that includes at least a first nozzle row in which a plurality of nozzles capable of discharging a same type of ink are arranged in a predetermined nozzle row direction and a second nozzle row in which a plurality of nozzles capable of discharging the same type of ink are arranged in the nozzle row direction, in a main scanning direction intersecting with the nozzle row direction, wherein, when, out of a group of raster lines which are raster lines toward the main scanning direction and corresponds to odd-numbered positions in the nozzle row direction and a group of raster lines which corresponds to even-numbered positions in the nozzle row direction, one group of the raster lines is printed by discharging the ink from the nozzle row out of the first nozzle row and the second nozzle row, which precedes during the movement, and the other group of the raster lines is printed by discharging the ink from the nozzle row out of the first nozzle row and the second nozzle row, which follows during the movement, in a case in which a first printing mode is adopted, a ratio of the amount of the ink discharged from the following nozzle row with respect to the amount of the ink discharged from the preceding nozzle row, is set to be greater than the ratio thereof in a case in which a second printing mode different from the first printing mode is adopted.

2. The printing control apparatus according to claim 1, wherein a platen gap, which is a distance from a platen supporting a printing medium on which the ink is discharged to the printing head, in the first printing mode is wider than a platen gap in the second printing mode.

3. The printing control apparatus according to claim 1, wherein in the first printing mode, the printing medium on which the ink is discharged is used as a first printing medium, and in the second printing mode, the printing medium is used as a second printing medium, and wherein the first printing medium has a characteristic in which the ink is less likely to be blurred more than the second printing medium.

4. The printing control apparatus according to claim 1, wherein the first printing mode has the printing resolution in the main scanning direction higher than the printing resolution of the second printing mode.

5. The printing control apparatus according to claim 1, wherein, when a dither matrix including a plurality of threshold values corresponding to each pixel is applied to image data in which a density of the ink in each of pixels constituting an image is expressed by gradation, printing data in which discharging or non-discharging of the ink in each pixel is determined is generated, and discharging of the ink from each nozzle is controlled according to the printing data, so that printing is realized, in the first printing mode, by comparing the dither matrix used in the second printing mode, the dither matrix is used in which the plurality of threshold values corresponding to each pixel expressing the other group of the raster lines printed using the following nozzle row has many distributed low values more than the plurality of threshold values corresponding to each pixel expressing one group of the raster lines printed using the preceding nozzle row.

6. The printing control apparatus according to claim 5, wherein, when the printing is realized by discharging the ink according to each movement of a main passage and a return passage in the main scanning direction by the printing head, the group of the raster lines corresponding to the even-numbered positions using the following nozzle row in the movement of the return passage is printed in a case in which the group of the raster lines corresponding to the odd-numbered positions using the following nozzle row in the movement of the main passage is printed, the group of the raster lines corresponding to the odd-numbered positions using the following nozzle row in the movement of the return passage is printed in a case in which the group of the raster lines corresponding to the even-numbered positions using the following nozzle row in the movement of the main passage is printed, and at least in the first printing mode, the dither matrix which is applied to a region where printing is performed by the main passage movement in the image, is different from the dither matrix which is applied to a region where printing is performed by the return passage movement in the image.

7. The printing control apparatus according to claim 5, wherein the dither matrix used in the first printing mode has all of the plurality of threshold values corresponding to each pixel expressing the other group of the raster lines printed using the following nozzle row, which are lower than all of the plurality of threshold values corresponding to each pixel expressing one group of the raster lines printed using the preceding nozzle row.

8. A printing control method causes a printing control apparatus to discharge ink from nozzles, while moving a printing head that includes at least a first nozzle row in which a plurality of nozzles capable of discharging a same type of ink are arranged in a predetermined nozzle row direction and a second nozzle row in which a plurality of nozzles capable of discharging the same type of ink are arranged in the nozzle row direction, in a main scanning direction intersecting with the nozzle row direction, wherein, when, out of a group of raster lines which are raster lines toward the main scanning direction and corresponds to odd-numbered positions in the nozzle row direction and a group of raster lines which corresponds to even-numbered positions in the nozzle row direction, one group of the raster lines is printed by discharging the ink from the nozzle row out of the first nozzle row and the second nozzle row, which precedes during the movement, and the other group of the raster lines is printed by discharging the ink from the nozzle row out of the first nozzle row and the second nozzle row, which follows during the movement, in a case in which a first printing mode is adopted, a ratio of an amount of the ink discharged from the following nozzle row with respect to an amount of the ink discharged from the preceding nozzle row, is set to be greater than the ratio thereof in a case in which a second printing mode different from the first printing mode is adopted.

* * * * *